US010201467B2

(12) United States Patent
Wood et al.

(10) Patent No.: US 10,201,467 B2
(45) Date of Patent: Feb. 12, 2019

(54) SURGICAL ACCESSORY INTERFACE DEVICE

(75) Inventors: Carol Anne Wood, Somerville, MA (US); Ryan Rasmussen, Marlborough, MA (US); Anthony Victor Catacchio, Rochdale, MA (US); Jesse S. Drake, Westborough, MA (US)

(73) Assignee: Allen Medical Systems, Inc., Batesville, IN (US)

( * ) Notice: Subject to any disclaimer, the term of this patent is extended or adjusted under 35 U.S.C. 154(b) by 1491 days.

(21) Appl. No.: 13/490,064

(22) Filed: Jun. 6, 2012

(65) Prior Publication Data

US 2013/0326818 A1 Dec. 12, 2013

(51) Int. Cl.
*A61G 13/10* (2006.01)
*A61G 13/12* (2006.01)

(52) U.S. Cl.
CPC ..... *A61G 13/101* (2013.01); *A61G 13/125* (2013.01); *A61G 13/1235* (2013.01); *A61G 13/1245* (2013.01)

(58) Field of Classification Search
CPC .. A61G 13/10; A61G 13/101; A61G 13/1205; A61G 13/121; A61G 13/122; A61G 13/1225; A61G 13/123; A61G 13/1235; A61G 13/124; A61G 13/1245; A61G 13/125; A61G 13/1255; A61G 7/065; A61G 7/07; A61G 7/075; A61G 7/0755; A61G 7/1082; A61G 7/1096; A61G 7/1098
USPC ..... 5/658, 503.1, 621–624, 646–651
See application file for complete search history.

(56) References Cited

U.S. PATENT DOCUMENTS

| | | | | |
|---|---|---|---|---|
| 2,711,300 | A | | 1/1955 | Nelson |
| 3,044,123 | A | | 6/1962 | Weickgenannt |
| 3,046,072 | A | * | 7/1962 | Douglass, Jr. et al. ..... 5/646 |
| 3,124,328 | A | | 3/1964 | Kortsch |
| 3,355,163 | A | | 11/1967 | Leinassar |
| 4,526,355 | A | * | 7/1985 | Moore et al. ..... 5/624 |
| 4,547,092 | A | | 10/1985 | Vetter et al. |
| 4,698,837 | A | * | 10/1987 | Van Steenburg ..... 378/208 |
| 4,796,846 | A | * | 1/1989 | Meier et al. ..... 248/286.1 |
| 4,865,484 | A | * | 9/1989 | McConnell ..... 403/59 |
| 4,913,413 | A | * | 4/1990 | Raab ..... 5/624 |
| 5,135,210 | A | * | 8/1992 | Michelson ..... 5/658 |
| 5,560,577 | A | * | 10/1996 | Keselman ..... 248/279.1 |
| 5,582,379 | A | | 12/1996 | Keselman et al. |
| 6,315,260 | B1 | * | 11/2001 | Lees ..... 248/286.1 |
| 6,375,133 | B1 | | 4/2002 | Morrow |
| 6,619,599 | B2 | * | 9/2003 | Elliott et al. ..... 248/125.8 |
| 6,663,055 | B2 | * | 12/2003 | Boucher et al. ..... 248/118 |

(Continued)

OTHER PUBLICATIONS

Communication pursuant to Article 94(3) EPS for EP Application 11152518.4, dated Aug. 14, 2014; received Aug. 19, 2014.

(Continued)

*Primary Examiner* — Robert G Santos
(74) *Attorney, Agent, or Firm* — Kenneth C. Baran

(57) ABSTRACT

An interface device (60) for mounting an accessory to a host (30), comprises a base (62) mountable on the host, a carrier (120) rotatably secured to the base, and a latch (130) having an engaged state in which the latch engages the base and resists rotation of the carrier relative to the base, and a disengaged state in which the latch permits rotation of the carrier relative to the base.

14 Claims, 9 Drawing Sheets

(56) References Cited

U.S. PATENT DOCUMENTS

| | | | | |
|---|---|---|---|---|
| 7,857,271 | B2 * | 12/2010 | Lees | 248/286.1 |
| 8,099,808 | B1 * | 1/2012 | McKeon | 5/624 |
| 8,132,278 | B1 | 3/2012 | Bailey | |
| 8,443,472 | B2 * | 5/2013 | Sherman et al. | 5/503.1 |
| 2001/0039680 | A1 * | 11/2001 | Boucher et al. | 5/623 |
| 2002/0104934 | A1 * | 8/2002 | Elliott et al. | 248/126 |
| 2006/0290076 | A1 * | 12/2006 | Lees | 279/44 |
| 2010/0146702 | A1 * | 6/2010 | Sherman et al. | 5/503.1 |
| 2011/0101587 | A1 | 5/2011 | Quintania et al. | |
| 2011/0121149 | A1 | 5/2011 | Herskovic | |
| 2013/0326818 | A1 * | 12/2013 | Wood et al. | 5/658 |
| 2015/0366622 | A1 * | 12/2015 | Wyslucha | F16D 41/105 5/648 |

OTHER PUBLICATIONS

EP Search Report for Application 13170684.8; Place of Search—The Hague; Date of Completion of the Search—Dec. 19, 2013.
Response to Office Action dated Aug. 18, 2014 for EP Application No. 13170684.8 dated Feb. 24, 2015.
Amended Page for EP Application No. 13170684.8—Final.
Amended Page for EP Application No. 13170684.8—Tracked.
Claims p. 1 for EP Application No. 13170684.8—Tracked.
Claims p. 1 for EP Application No. 13170684.8—Final.
Response to European Search Report for European Patent Application 13170684.8; dated Jul. 22, 2014.
Amended Page—Final—for European Patent Application 13170684.8.
Amended Page—Tracked Changes—European Patent Application 13170684.8.
Amended Claims—Final—or European Patent Application 13170684.8.
Amended Claims—Tracked Changes—for European Patent Application 13170684.8.
Communication of a notice of opposition; Application EP 13170684.8; dated Apr. 25, 2017; Received May 2, 2017.
Response to Summons to attend Oral Proceedings on Nov. 8, 2018 for European Patent No. 2671558; response dated Sep. 3, 2018.
Main Request (Final) for European Patent No. 2671558.
Main Request (Tracked) for European Patent No. 2671558.
Summons to attend oral proceedings pursuant to Rule 115(1) EPC for EP Application 13170684.8; dated Mar. 15, 2018.

* cited by examiner

SURGICAL ACCESSORY INTERFACE DEVICE

TECHNICAL FIELD

The subject matter described herein relates to an interface device for mounting an accessory on a host, in particular a device for mounting a surgical accessory on a surgical table.

BACKGROUND

Surgical tables and fracture frames, such as those used for orthopedic surgery and procedures, can be outfitted with a variety of accessories to maintain a patient's limbs in desired positions and orientations and/or to apply traction during surgery. In order to achieve the desired position and orientation of the patient's limbs it is often necessary to employ a variety of extensions connected to each other to form a limb support assembly. For example it may be necessary to attach a straight extension to the surgical table, attach an L-shaped extension to the straight extension, attach a second L-shaped extension to the first L-shaped extension, and attach a traction boot (worn on the patient's foot) to the second L-shaped extension. As a result the surgical facility must purchase and maintain an inventory of extensions. In addition, conventional extensions, once attached to the table or to each other, cannot always be conveniently repositioned without a certain amount of dismounting, disassembly, remounting and reassembly of the limb support assembly.

SUMMARY

An interface device for mounting an accessory to a host comprises a base which can be mounted on the host, a carrier rotatably secured to the base, and a latch. The latch has an engaged state in which the it engages the base and resists rotation of the carrier relative to the base, and a disengaged state in which the latch permits rotation of the carrier relative to the base. The rotatability of the carrier enables the surgical staff to easily and conveniently achieve a wide range of positions and orientations of a patient's limbs without using numerous extensions and without dismounting and disassembling the limb support assembly.

BRIEF DESCRIPTION OF THE DRAWINGS

The foregoing and other features of the various embodiments of the interface device described herein will become more apparent from the following detailed description and the accompanying drawings in which.

DETAILED DESCRIPTION

Figure 1:
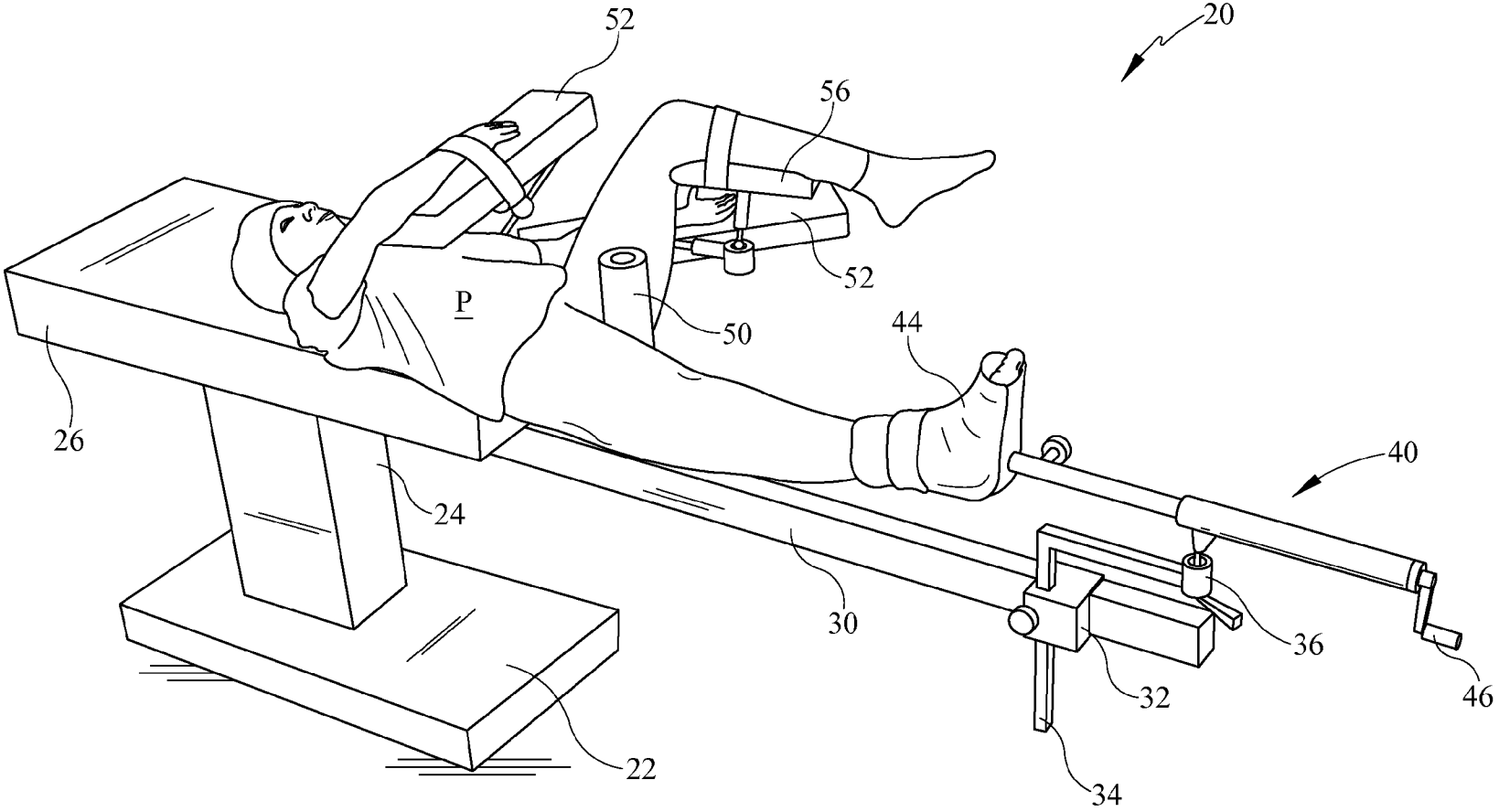
PRIOR ART FIG. 1
FIG. 1 is a perspective view showing an orthopedic surgical table with a conventional accessory support comprised of a clamp clamped to a spar of a surgical table and an L-shaped extension gripped by the clamp, and also showing a patient positioned for a surgical procedure.

FIG. 1 shows a surgical table 20 comprised of a base unit 22, a pedestal 24 extending vertically from the base unit and an occupant support platform 26 supported on the pedastal. A removable spar 30 extends longitudinally from the support platform near the right side thereof. A second spar may be attached to the left side of the support platform if required. A removable clamp 32 is mounted on the spar. Clamp 32 grips an L-shaped extension 34 having a socket 36. A traction unit 40 is mounted on the extension by a ball element which resides inside the socket and therefore is not visible in the illustration. One end of the traction unit is connected to a traction boot 44 worn by patient P. A crank 46 projects from the other end of the traction unit. A countertraction post 50 extends vertically from the table between the patient's legs. A member of a surgical team uses the crank to cause the traction unit to apply traction to the patient's right leg. The traction unit is only one example of an accessory that can be mounted on the extension. Other surgical accessories can be employed independently or in conjunction with a traction unit to maintain one or more of the patient's limbs in desired positions and orientations for surgery. Other example accessories include armboards 52 shown supporting the patient's arms, and a leg stirrup 56 shown supporting the patient's left calf.

Figure 2:
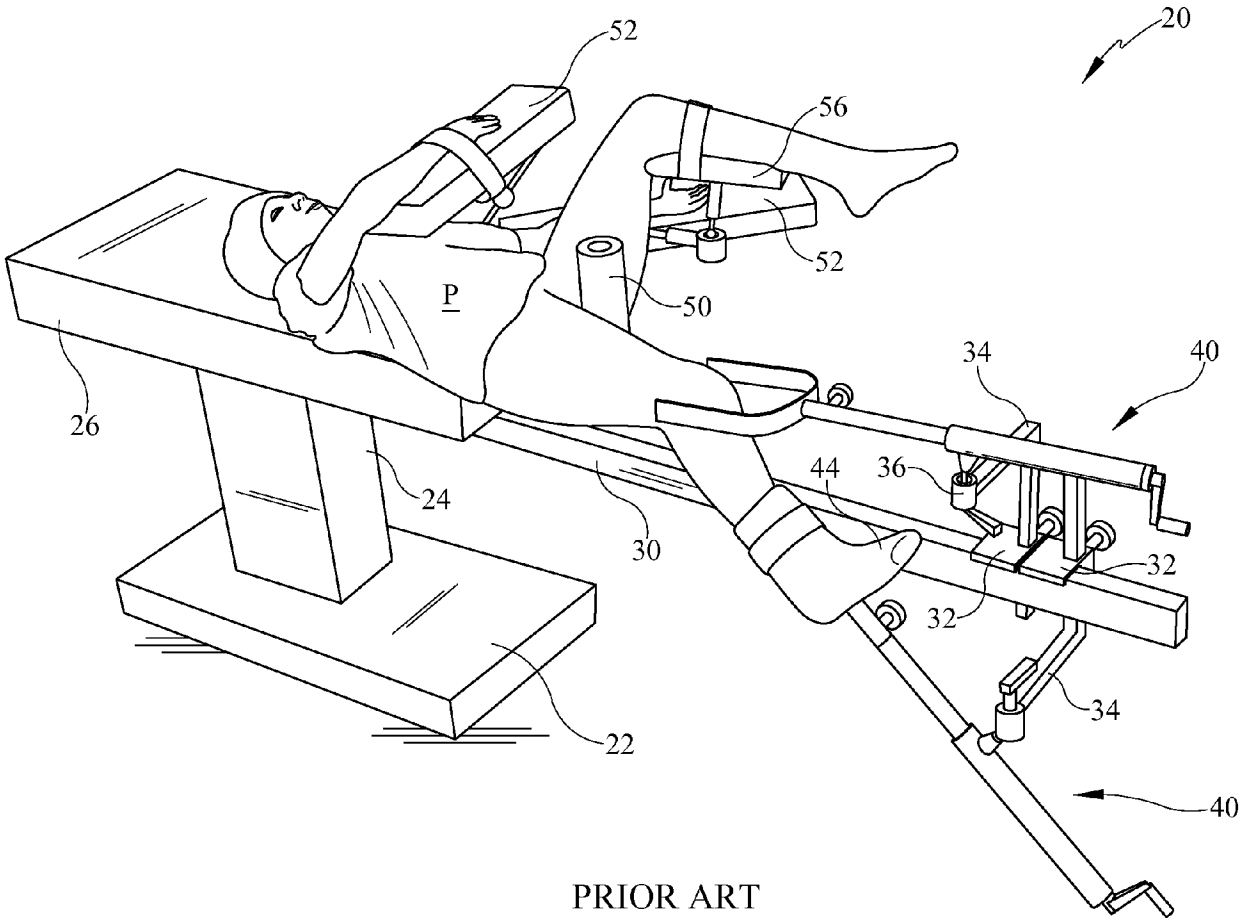
PRIOR ART FIG. 2
FIG. 2 is a view similar to that of FIG. 1 showing a patient positioned differently for a different surgical procedure.
Figure 3:
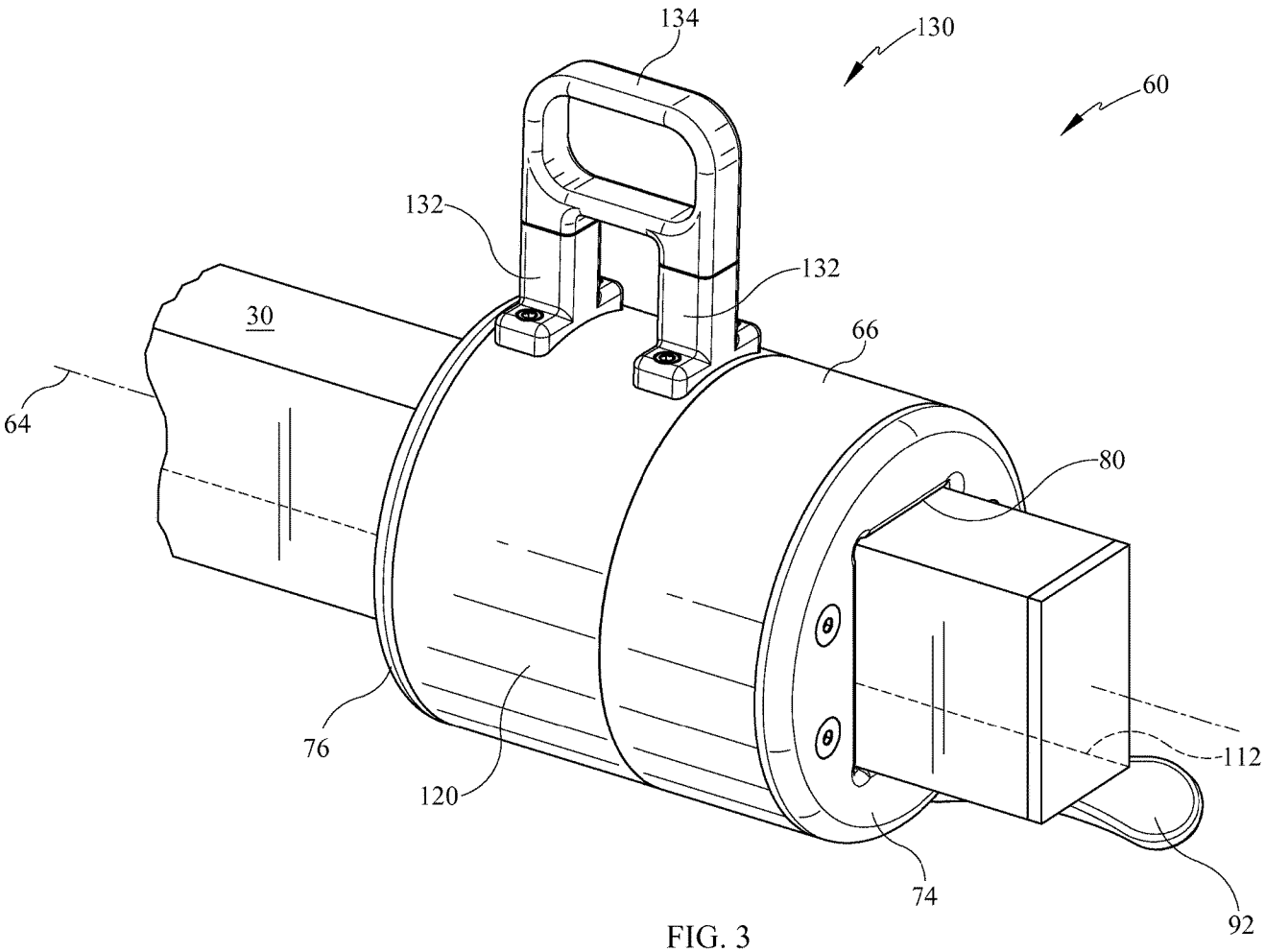
FIG. 3 is a perspective view of an accessory interface device which comprises a base mounted on a spar of a surgical table, an accessory carrier, and a latch.
Figure 4:
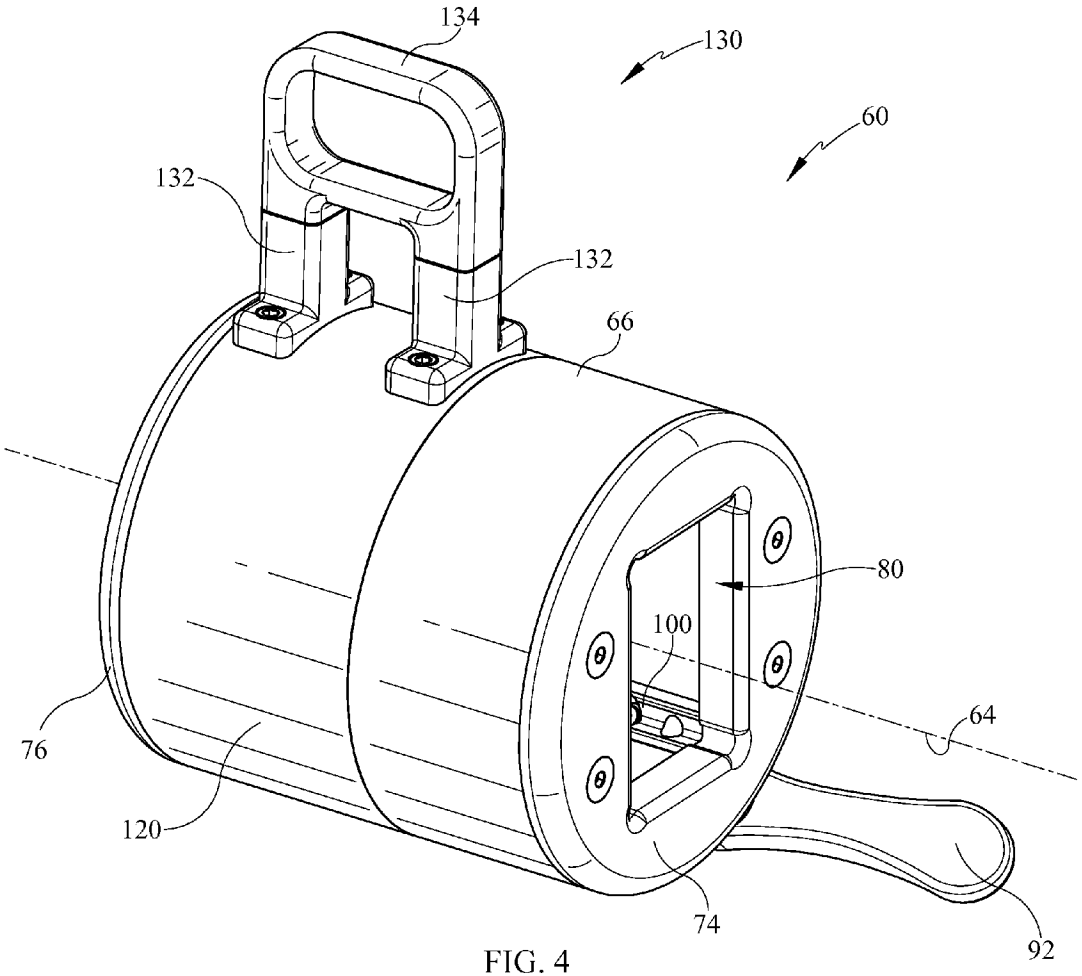
FIG. 4 is a view similar to that of FIG. 3 but with the interface device having been dismounted from the spar.
Figure 5:
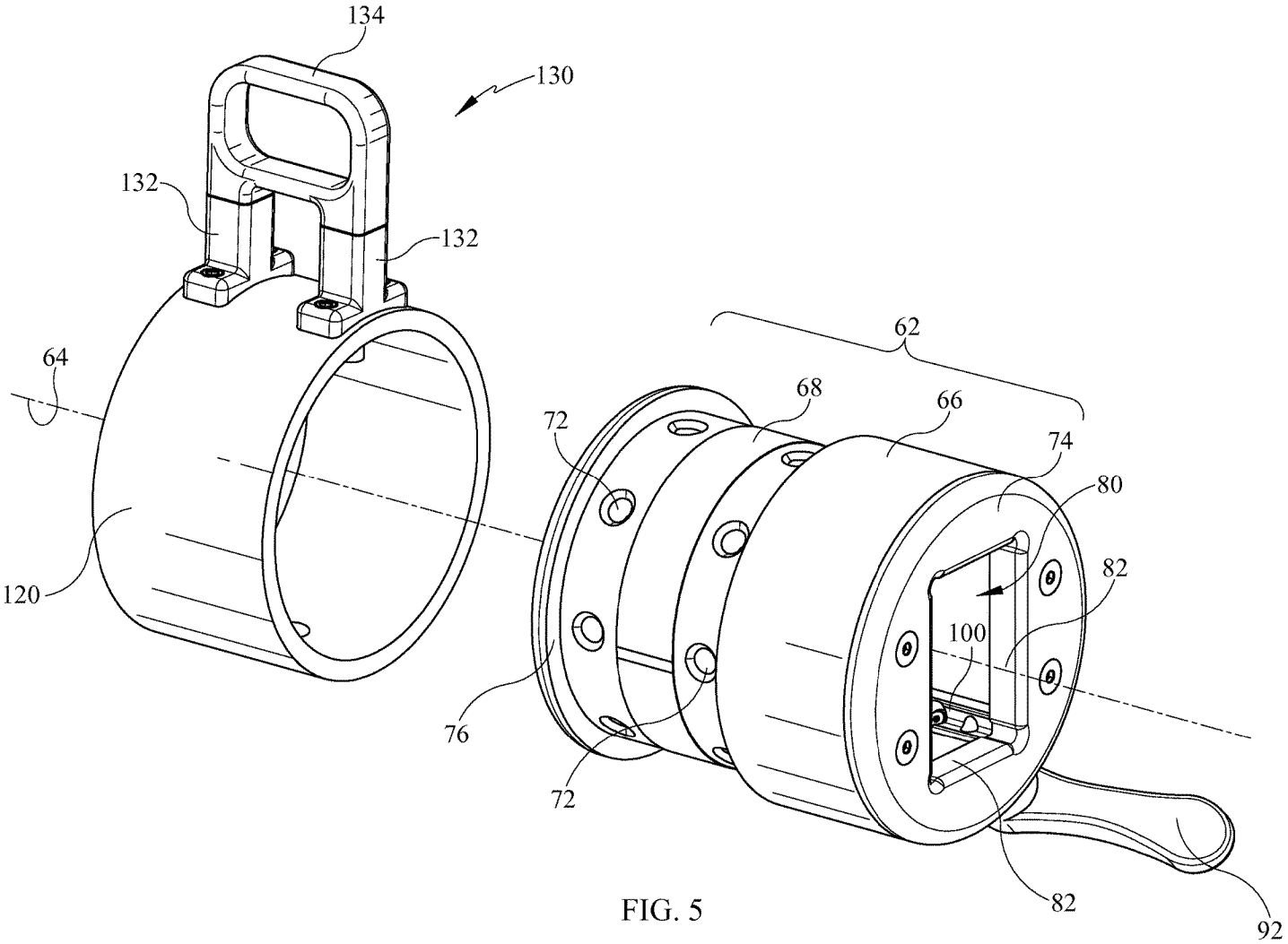
FIG. 5 is a view of the interface device partially exploded.

FIG. 2 shows the surgical table with the patient positioned differently for a different surgical procedure. In particular the surgery requires the patient's right leg to be bent slightly at the knee. Accordingly, the orientation of extension 34 differs from its orientation in FIG. 1 in order to accommodate a different orientation of traction unit 40. FIG. 2 also shows a second traction unit 40 mounted on the spar by a second extension 34 and a second spar clamp 32.

FIGS. 3-6 show an accessory interface device 60 for mounting an accessory to a host, such as a surgical table. The device includes a base 62 mountable on the host, specifically on a host component such as spar 30. The base is in the form of a drum having a longitudinally extending axis 64, a first cylindrical portion 66 having a first diameter, and a second cylindrical portion 68 longitudinally neighboring the first cylindrical portion and having a second diameter smaller than the first diameter. Two rows of sockets 72 extend around the circumference of the second cylindrical portion. The sockets of each row are spaced at 45° increments, and the sockets of each row are circumferentially aligned with the sockets of the other row. A first end cap 74 is affixed to a first end of the drum, and a second end cap 76 is affixed to a second end of the drum. Each end cap has a rectangular opening 80. As used herein the word "rectanglular" encompasses the special case of a square. Openings of other geometries may also be used. The rectangular openings are each dimensioned to receive spar 30 having a similarly dimensioned rectangular profile. As a result the device base 62 fits snugly on the spar but with enough clearance that the device can be slid along the spar to a longitudinal position suitable for the patient. Openings 80 are bounded by a bearing surface 82 which is made of a low friction material to facilitate the relative sliding motion between the spar and the drum. The interior of the drum is unobstructed between openings 80 to accommodate extension of the spar through the interior and longitudinally past each end cap.

Figure 6:
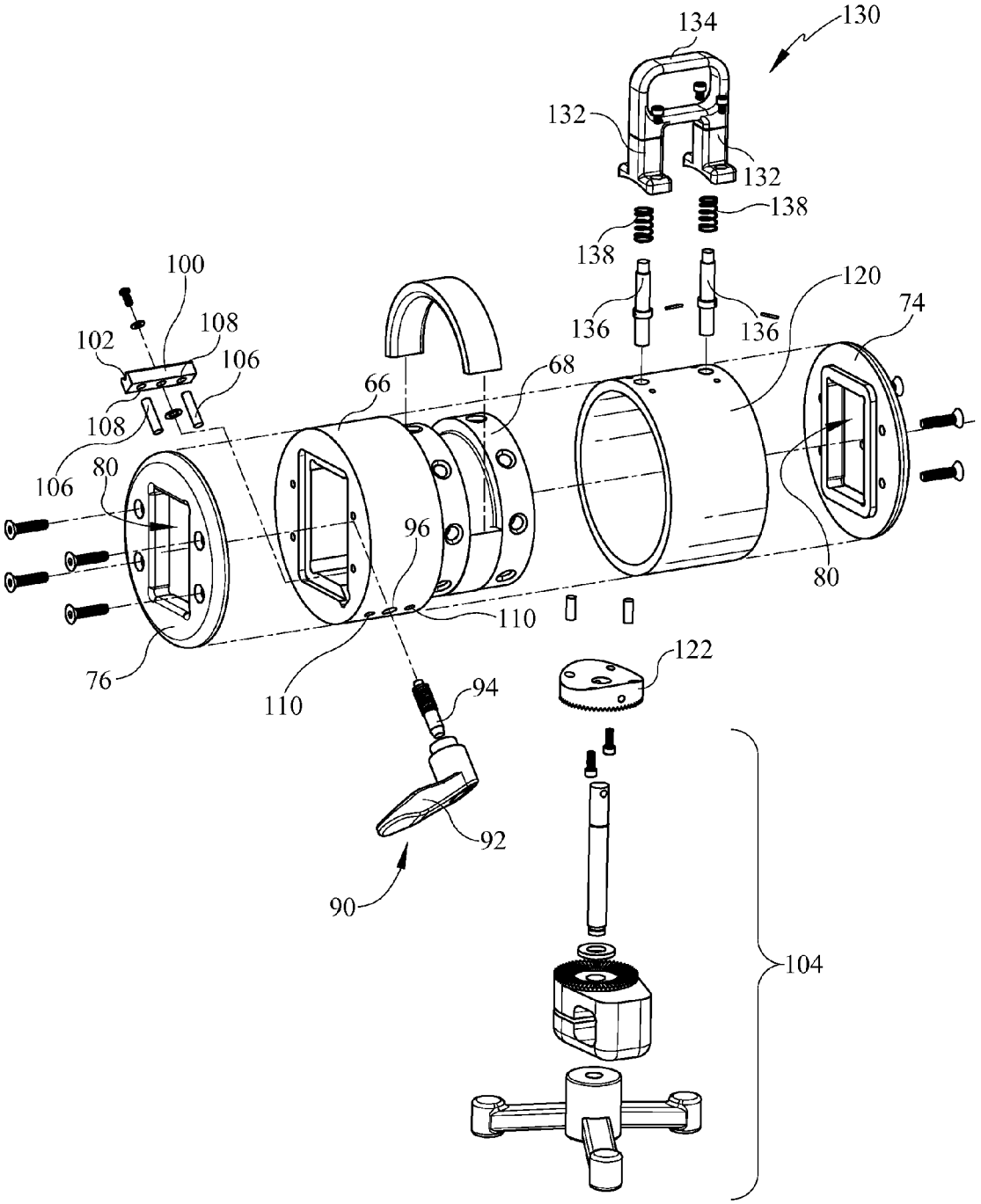
FIG. 6 is an exploded perspective view of the interface device and an accessory mounting assembly.
Figure 7:
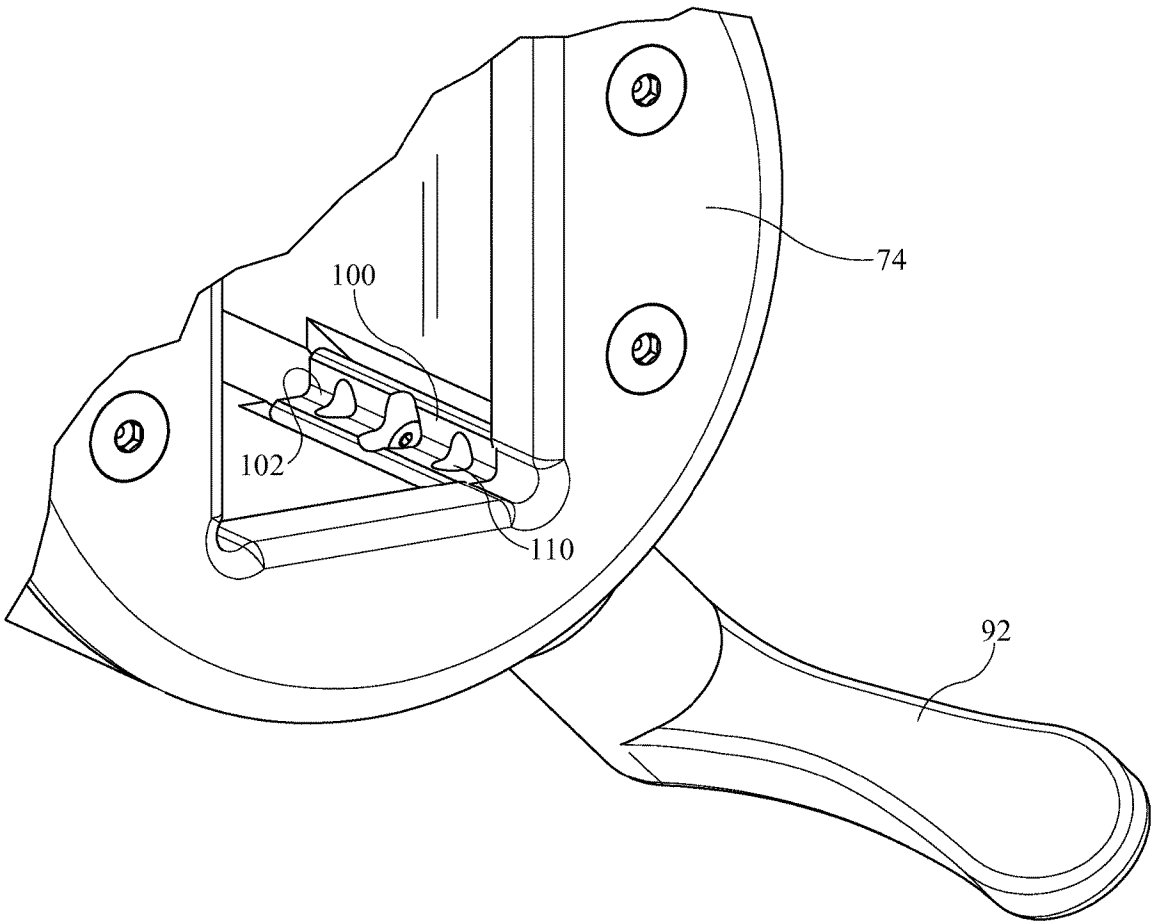
FIG. 7 is a partial perspective view showing an attachment clamp for removably securing the interface device to a host component.

Referring principally to FIGS. 6-7, an attachment clamp 90 comprises a handle 92 and a threaded shank 94 extending from the handle and into a threaded hole 96 so that rotation of the handle translates the shank radially. The attachment clamp also includes a locking bar 100 positioned inside the drum and screwed to the end of shank 94 remote from handle 92. Bar 100 has a radially inwardly facing 90° notch 102. A pair of guide pins 106 fit tightly in holes 108 of locking bar 100 and project into holes 110 in the drum. The fit between pins 106 and holes 110 is slightly loose so that the pins can slide radially in the holes. Once the interface device 60 is longitudinally positioned along the spar to the user's satisfaction, the user rotates handle 92 thereby forcing locking bar 100 against a corner (e.g. corner 112) of the spar and causing the bar to engage the spar and clamp the device in place longitudinally. The projection of guide pins 106 into holes 110 prevent bar 100 from rotating about the shank axis during rotation of the handle. Opposite rotation of handle 92 disengages the wedge from the spar.

Figure 9:
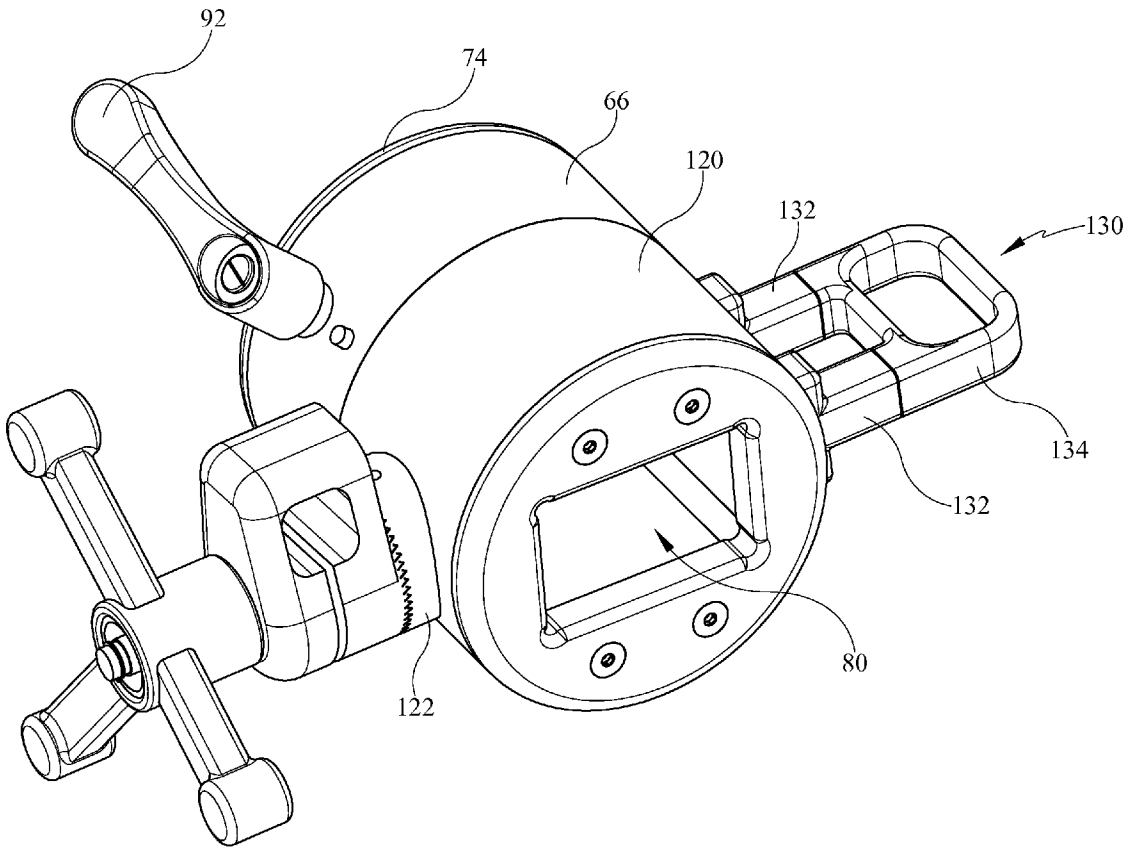
FIG. 9 is a perspective view of the accessory mounting assembly of FIG. 6

The interface device also includes an accessory carrier 120 which circumscribes the second (smaller diameter) portion 68 of drum 62. The carrier is a substantially cylindrical ring whose radial thickness is substantially equal to the difference between the diameters of the first and second drum portions 66, 68. The carrier is rotatably secured to the base, for example by being nested between second end cap 76 and the larger diameter portion of the drum. The carrier includes a receiver 122 for receiving an accessory. In the embodiment of FIG. 6 the receiver comprises one member of a rosette coupling however other types of receivers may also be employed. FIG. 6 also shows an accessory 104 whose constituent components include the other member of the rosette coupling. Accessory 104 is a clamp however other types of accessories may also be used. FIG. 9 shows clamp/accessory 104 installed on the carrier.

Figure 8:
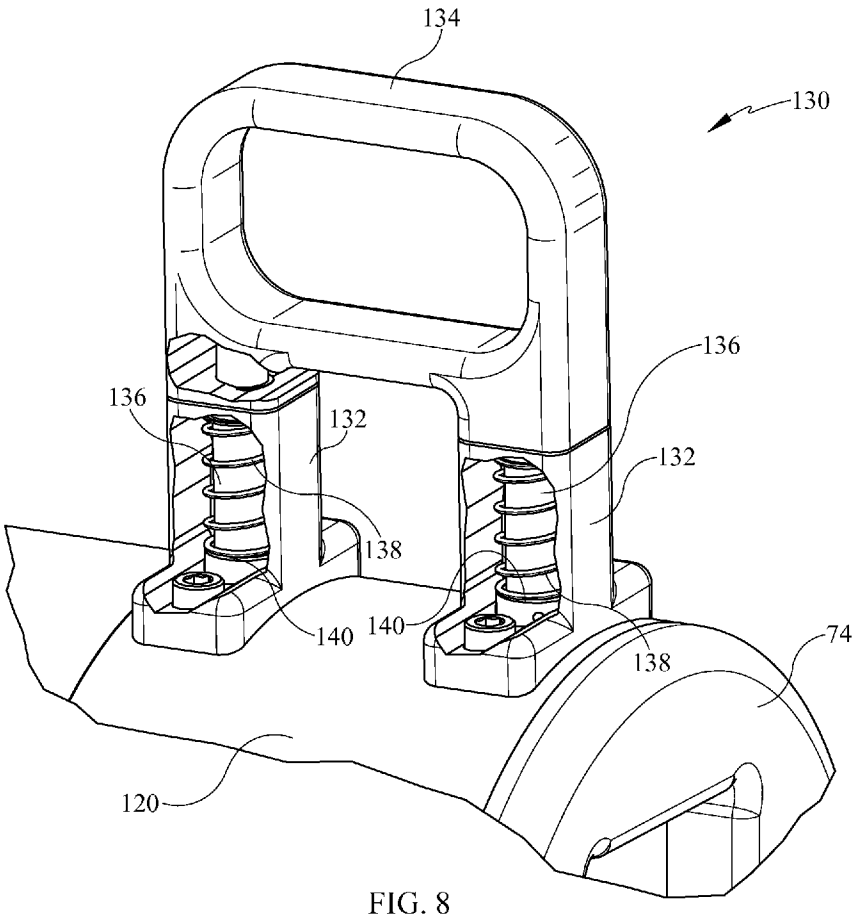
FIG. 8 is a partial perspective view showing a latch mounted on the carrier component of the interface device.

Referring to FIGS. 6 and 8, the interface device also includes a latch 130 comprised of a handle assembly which includes a pair of pedestals 132 secured to the carrier and a handle 134 positioned atop the pedestals. Latch pins 136 project from the handle and extend through both the interior of the pedestals and the carrier 120. A coil spring 138 circumscribes each latch pin and is trapped inside the pedestal between a pedestal upper surface (not visible) and a shoulder 140 on the pin. Springs 138 bias each pin into contact with the base. The latch has an engaged state in which the radially inner ends of pins 136 project into sockets 72 in the smaller diameter portion of the drum thereby resisting rotation of the carrier relative to the base. When a user elects to reposition the carrier and any accessory attached thereto, the user disengages the latch by pulling on the handle in a radially outward direction to retract the pins out of the sockets. The user then uses the handle to rotate the carrier about axis 64. Once the pins are no longer circumferentially aligned with sockets 72 the user can discontinue pulling radially on the handle with the result that springs 138 will bias the pins back into contact with the drum. Once the carrier has been rotated enough to align the pins with another set of sockets, springs 138 urge the pins into those sockets to once again latch the carrier in place and prevent further rotation.

Although this disclosure refers to specific embodiments, it will be understood by those skilled in the art that various changes in form and detail may be made without departing from the subject matter set forth in the accompanying claims.

We claim:

1. An interface device for mounting an accessory to a host, comprising:

a base mountable on the host;

a carrier rotatably secured to the base; and a latch secured to the carrier, the latch having an engaged state in which the latch engages the base and prevents rotation of the carrier relative to the base in both of two opposite rotational directions, and a disengaged state in which the latch is disengaged from the base thereby enabling rotation of the carrier relative to the base in both rotational directions.

2. The interface device of claim 1 in which the carrier includes a receiver for receiving an accessory.

3. The interface device of claim 2 in which the receiver comprises at least part of a rosette coupling.

4. The interface device of claim 1 in which the base comprises a drum having a longitudinally extending axis, a first end cap affixed to a first end of the drum, and a second end cap affixed to a second end of the drum, each end cap having an opening therein, the interior of the drum being unobstructed between the openings to accommodate extension of a host component through the interior and longitudinally past each end cap.

5. The device of claim 4 in which the openings are rectangular openings for receiving a host component having a rectangular profile.

6. The device of claim 4 in which the openings are bounded by a bearing surface.

7. The device of claim 1 in which the base includes an attachment clamp.

8. The device of claim 7 in which the attachment clamp comprises a locking bar engageable with and disengageable from a host component.

9. The device of claim 1 in which:

the base includes a first cylindrical portion having a first diameter, a second cylindrical portion longitudinally neighboring the first cylindrical portion and having a second diameter smaller than the first diameter; and the carrier is a substantially cylindrical ring that circumscribes the second portion and has a radial thickness substantially equal to the difference between the first and second diameters.

10. The device of claim 9 in which the carrier includes at least one latch pin, and the base includes circumferentially distributed sockets longitudinally aligned with the at least one latch pin for receiving the at least one latch pin when the at least one latch pin is circumferentially aligned with one of the sockets.

11. The device of claim 1 in which the latch comprises a handle and a pin extending through the carrier, the pin being biased into engagement with the base and disengageable from the base in response to movement of the handle in a direction to overcome the bias.

12. The device of claim 1 wherein the latch is disengagable from the base in response to a force acting perpendicular to the rotational directions.

13. The device of claim 1 wherein:

the base comprises a cylindrical portion having a first and second rows of circumferentially distributed sockets, the rows of sockets being longitudinally spaced from each other, the sockets of each row being circumferentially aligned with each other;

the latch comprising a first latch pin longitudinally aligned with the first row of sockets and a second latch pin longitudinally aligned with the second row of sockets.

14. The device of claim 1 wherein the base includes a socket and wherein the latch includes a pedestal secured to the carrier, a handle atop the pedestal, a latch pin and a spring which biases the latch pin toward the base so that in the engaged state the latch pin projects into the socket and in the disengaged state the latch pin does not project into the socket.

* * * * *